US005596851A

United States Patent [19]

Ting

[11] Patent Number: 5,596,851

[45] Date of Patent: Jan. 28, 1997

[54] EXTERIOR WALL PERIMETERS

[76] Inventor: Raymond M. L. Ting, 318 Holiday Dr., Pittsburgh, Pa. 15237

[21] Appl. No.: 372,554

[22] Filed: Jan. 13, 1995

[51] Int. Cl.[6] ..... E06B 1/04

[52] U.S. Cl. ..... 52/211; 52/213; 52/393

[58] Field of Search ..... 52/211, 213, 393

[56] References Cited

U.S. PATENT DOCUMENTS 5,027,572 7/1991 Purcell et al. ..... 52/393 X 5,090,168 2/1992 Fast et al. ..... 52/213

*Primary Examiner*—Carl D. Friedman

*Assistant Examiner*—W. Glenn Edwards

*Attorney, Agent, or Firm*—Michael J. Kline; Noland J. Cheung; Carol I. Bordas

[57] ABSTRACT

A system is provided, wherein the watertight performance of exterior wall perimeters is addressed such as the perimeters of a window, a door, or a curtain wall system. The perimeter sealant lines are classified into P.E. Seal bordering no differential air pressure and D.P. Seal bordering a differential air pressure. Long lasting watertight performance is accomplished by using P.E. Seal in the area of the water path and D.P. Seal away from the water path. The design is accomplished by using combinations of an inner transition member, an exterior perimeter member, pressure equalization holes, and pressure equalized wall cavities.

19 Claims, 7 Drawing Sheets

EXTERIOR WALL PERIMETERS

FIELD OF THE INVENTION

This invention relates to the method of providing long-lasting watertight performance along the perimeter lines between exterior wall openings and their enclosing structures. More specifically, watertight performance is accomplished by using a Pressure Equalized Seal in the area of the water path and a Differential Pressure Seal away from the water path.

DESCRIPTION OF THE PRIOR ART

Typical examples of enclosing structures for exterior wall openings are windows and entrance doors in masonry walls, composite walls, and walls of residential houses. These are openings in a bearing wall type of construction in which the windows and doors are supported by the surrounding walls. For a relatively large opening, the opening is normally enclosed by non-bearing type curtain walls supported by vertical mullions. When the curtain wall terminates at a solid base surface or at a solid wall opening surface, the perimeter lines represent a critical point for water infiltration.

In dealing with the water infiltration problem along these perimeter lines, the prior art relies almost exclusively on field-applied exposed silicone caulking to seal the perimeter sealant lines. The watertight performance of such perimeter sealant lines depends on good field workmanship, which is extremely difficult to control, and the durability of the sealant material, which inevitably degrades under the effects of exposure to temperature extremes, sun, air, and elements. Therefore, water infiltration through perimeter lines is inevitable and periodic repairs are common practice in the industry.

One of the major problems associated with water infiltration is detecting the problem. Generally, water infiltration is discovered only after prolonged and insidious water infiltration causes extensive, noticeable damage. Examples of such damage are wet-down of the internal wall insulation material, disintegration of water absorbing wall liner material, wall panels falling off the building due to the corrosion of the wall anchoring clips, corrosion of steel wall studs, and numerous other water damage problems. Due to the undetectability of the initial water infiltration and the immense cost of late discovery, many building owners have adopted scheduled re-caulkings as a policy of necessary maintenance procedure.

A scheduled re-caulking policy may solve the durability problem of the sealant material; it does not, however, solve the field workmanship problem. Therefore, in addition to the economical burden, a scheduled re-caulking policy may reduce the incidence of the problem of water infiltration but would not eliminate the water infiltration. Also, scheduled recaulking is labor intensive, and thus expensive, and is an inefficient use of resources, particularly if scheduled maintenance is performed more frequently than required.

SUMMARY OF THE INVENTION

The solution to the water infiltration problem requires elimination of the dependency of good field workmanship and durability of sealant material. The objective of this invention is to provide a wall perimeter sealing design that can tolerate a significant degree of imperfection in the sealant line without causing water infiltration, such that the dependence of watertight performance on good workmanship in sealant application and durability of the sealant material is eliminated. This is to say that average workmanship will be adequate to achieve long-lasting, watertight performance.

In order to explain the working principles of this invention, the following terminologies are defined.

(1) Differential Pressure Seal or D.P. Seal: A sealant line between two air spaces having a significant differential air pressure. For the present invention, the sealant lines bordering the interior air space are considered D.P. Seals.

(2) Pressure Equalized Cavity or P.E. Cavity: A wall cavity space that allows the exterior air to flow in freely such that the air pressure within the wall cavity can approach the exterior air pressure in a short period of time.

(3) Pressure Equalized Seal or P.E. Seal: A sealant line placed between a pressure equalized wall cavity and the exterior air.

Generally, the combination of the following three elements cause water infiltration: 1) water running over the sealant line, 2) hairline cracks or pin holes in the exposed sealant line, and 3) differential air pressure forcing the water to infiltrate through the cracks or holes. The water infiltration problem can be solved if one or more and preferably all, of the above elements can be eliminated.

In the above-discussed conventional exposed sealant system, the sealant line cracks or holes cannot be prevented, due to the field workmanship problems and durability problems of the sealant material. The exposed sealant line is directly subjected to the influx of ambient water. Since the exposed sealant line is also required to seal off the air, it is impossible to create a P.E. Cavity to eliminate the pressure difference. Thus, the conventional exposed sealant system cannot solve the water infiltration problem.

In summary, the exposed sealant system cannot solve the water infiltration problem. In my previous U.S. Pat. No. (4,840,004) and my copending U.S. patent application Ser. No. 08/033,332, filed on 03/18/93, the solution was presented to solve the water infiltration problem along with joints between compatible panels of curtain wall. The water is prevented from reaching the D.P. Seal by employing a P.E. Cavity and a concealed drainage system. The perimeter condition of this invention presents a unique solution to the water infiltration problem along the perimeter sealant line between the exterior wall openings and the enclosing structures.

The objective of the present invention is accomplished by preventing the water from reaching the D.P. Seals using a concealed transition member with D.P. Seals located away from the water path and an exposed member with an exposed P.E. Seal such that water will not infiltrate through the P.E. Seal despite imperfections since the differential pressure is eliminated. The design functions of the present invention will become apparent in the explanations of the preferred embodiments.

DESCRIPTION OF THE PREFERRED EMBODIMENTS

Figure 1:
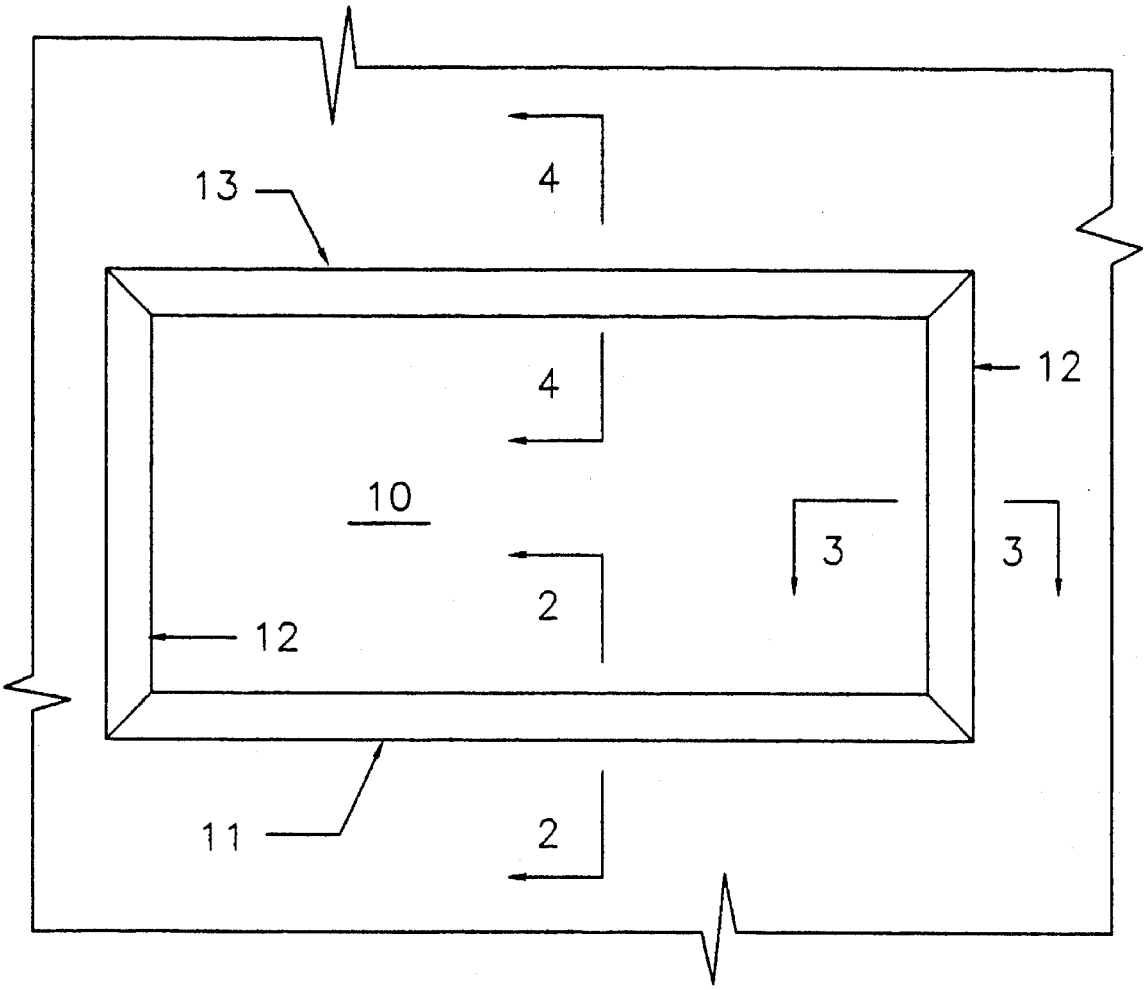
FIG. 1 is a partial elevation view of an exterior wall having a wall opening with four (4) sides with the perimeter conditions of the present invention.

FIG. 1 illustrates a partial exterior wall elevation with a wall opening 10-having four (4) sides having a horizontal sill perimeter 11, two confronting vertical jamb perimeters 12, and a horizontal head perimeter 13, all of the present invention.

Figure 2:
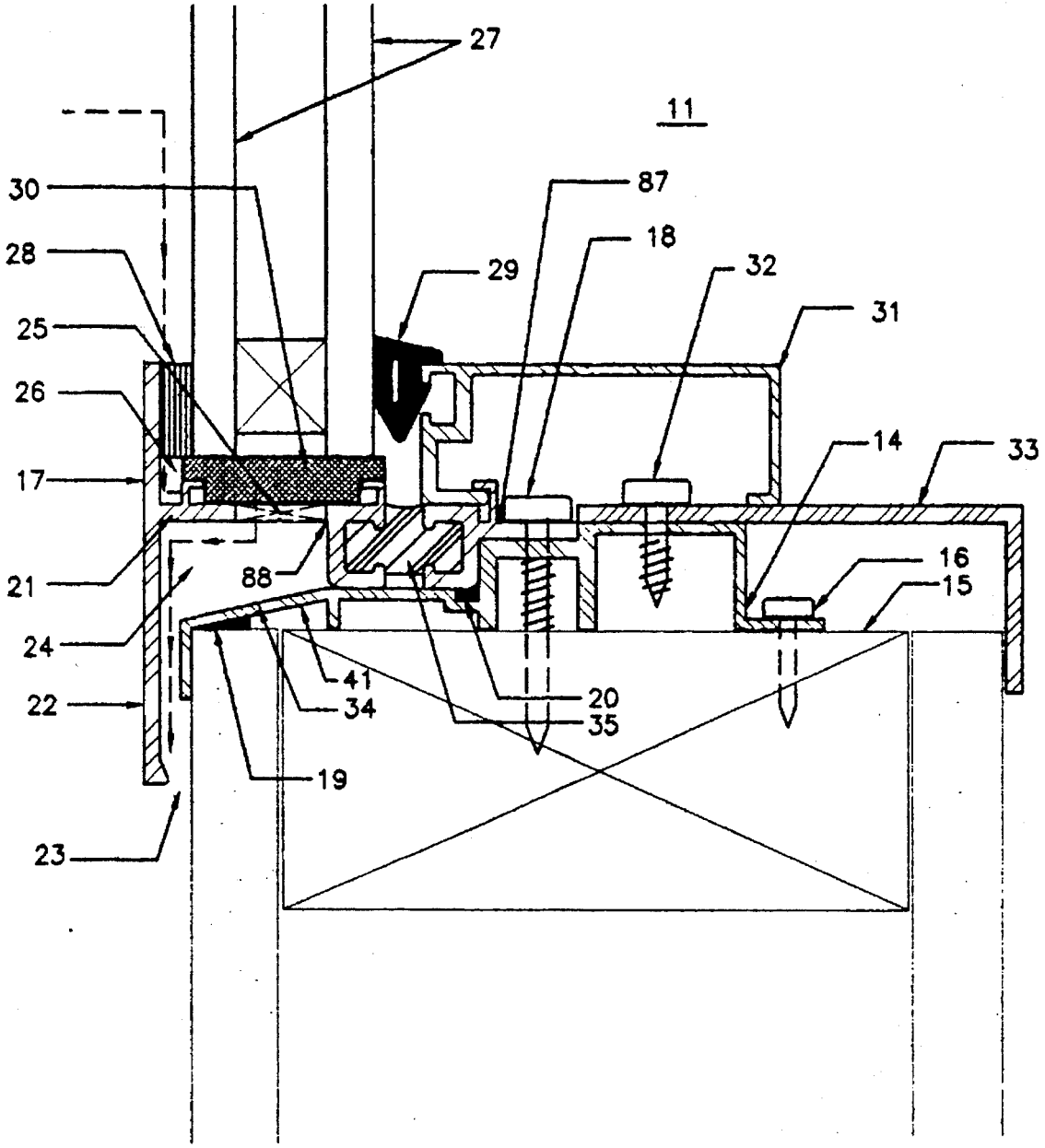
FIG. 2 is a typical fragmentary cross-sectional view taken along line 2—2 of FIG. 1 showing an example of the present invention at the sill condition of a fixed window system.

FIG. 2 shows an example fragmentary cross-section of the horizontal sill perimeter 11 of the present invention taken along line 2—2 of FIG. 1. This example as shown applies to window structures. The horizontal sill perimeter 11 of this invention consists of an inner transition member 14 fastened to the top of the wall opening surface 15 using spaced apart fasteners 16 and an exterior member 17 placed over the inner transition member 14 and fastened through the inner transition member 14 into the wall opening surface 15 using spaced apart fasteners 18. The exterior member 17 may include a thermal breaker 35 acting as an interconnecting member between the inner and outer portion 87 and 88 of the exterior member 17. The inner transition member 14 is sealed to the wall opening surface 15 by sealing caulking 19. It is also sealed between the inner transition member 14 and the exterior member 17 by sealing caulking 20. The exterior member 17 has a horizontal web 21 extended over the front portion 41 of the inner transition member 14 and a downward leg 22 extended to conceal the inner transition member 14 with an air gap 23 in between. As shown in FIG. 2, exterior air can freely flow through air gap 23 into the exterior sill cavity 24 formed between the inner transition member 14 and the exterior member 17. Therefore, the exterior sill cavity 24 is also a P.E. Cavity. Spaced apart pressure equalization holes 25 (shown in hidden lines) are provided in the horizontal web 21. These holes 25 allow the air in the exterior sill cavity 24 to freely enter into the interior sill cavity 26. Therefore, the interior sill cavity 26 also becomes a P.E. Cavity. As shown, the fixed window system has insulated dual-paned glass 27 structurally secured and weather sealed by an exterior sponge gasket tape 28 and an interior wedge gasket 29. The weight of the glass 27 is supported on two spaced apart setting blocks 30 having a combined length less than the length of the perimeter 11. Accordingly, air can flow from the exterior sill cavity 24 to the interior sill cavity 26 through holes 25, not covered by the setting blocks 30. A removable wedge block 31 is provided on the interior side of the glass 27 to create force in the wedge gasket 29 and to cover the fasteners 18 and 32 which are used to secure the interior edge flashing 33. A downwardly sloping surface 34 on the front part of the inner transition member 14 is provided to encourage water drainage away from the exterior sill cavity 24 and out through the air gap 23.

The watertight performance of the embodiment of the invention as illustrated in FIG. 2 is explained as follows. Since the interior sill cavity 26 is contrived to be a P.E. Cavity, the exterior sponge gasket tape 28 becomes a P.E. Seal. This design can sustain a high degree of sealing imperfection without permitting water infiltration from outside through sponge gasket tape 28 to the interior sill cavity 26, since there is no pressure differential between the outside and interior sill cavity 26, as shown in FIG. 2. Even if some incidental water infiltrates through the exterior sponge gasket tape 28 into the interior sill cavity 26, the water will be quickly drained through the holes 25 onto the sloping surface 34 and guided out through the air gap 23. The interior wedge gasket 29 and the sealing caulking 19 and 20 are D.P. Seals, however, they are not infringed by the water path described above. Thus, despite possible imperfection in these D.P. Seals, there will be no water infiltration through the D.P. Seals, since the exterior water is prevented from reaching them.

Referring again to FIG. 2, the inner transition member 14 is sealed to the wall opening surface 15 and the exterior member 17 with hidden sealing caulking 19 and 20, respectively a P.E. Cavity 24 being formed between the inner transition member 14 and the exterior member 17, the horizontal web 21 of member 17 having spaced apart pressure equalization holes 25, and a downwardly slopping surface 34 on the inner transition member 14 at the area below holes 25. Above web 21 or sealing caulking 20, the perimeter condition can assume various shapes or forms of windows, such as various operable windows.

The spacing and size of holes 25 required to be qualified as the pressure equalization holes depends on the air tightness of the D.P. Seals 19 and 20. In normal practice, a 0.5 inch (12.7 mm) diameter hole, spaced at a maximum spacing of 30 inches (762 mm) would be adequate. To qualify the cavity 24 as a P.E. Cavity, the air gap 23 should, in normal practice, be maintained at a minimum width of ⅛ inch (3.175 mm).

The material for members 14 and 17 can be any combinations of extruded aluminum, extruded PVC, or other suitable extrudable materials. As shown, the exterior member 17 is an aluminum extrusion with a thermal breaker 35. In order to prevent thru-metal thermal conductivity between inner transition member 14 and exterior member 17, it is preferred to use extruded PVC or other non-metal material for inner transition member 14. Alternatively, if inner transition member 14 is an aluminum extrusion, a gasket type of material can be placed at the contacting surface with exterior member 17 to impede thru-metal thermal conductivity.

Figure 2A:
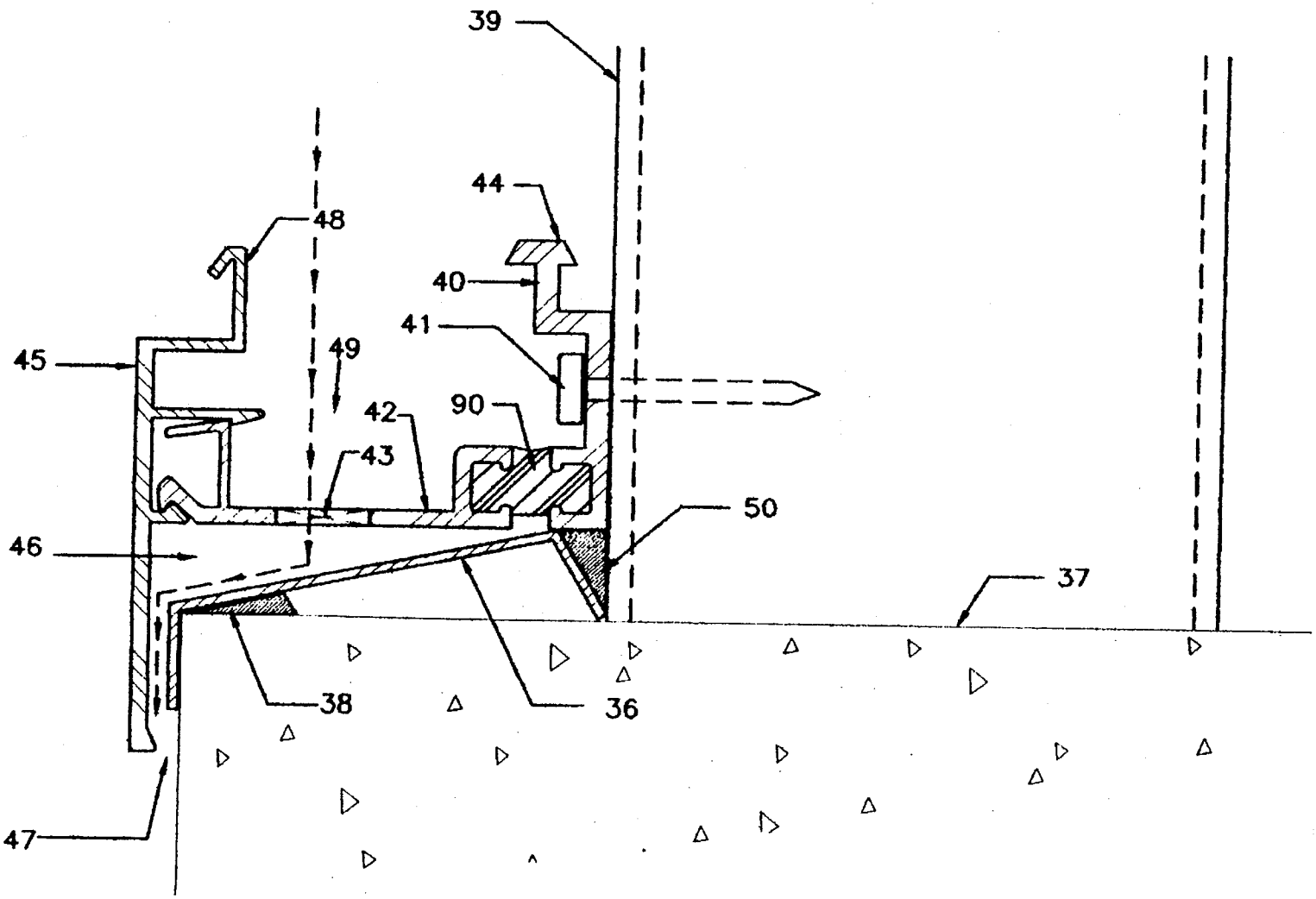
FIG. 2*a* is a variation of FIG. 2 showing an example of the present invention for the terminating sill condition of a curtain wall system.

FIG. 2*a* is a variation of FIG. 2 in which the sill condition terminates at a solid base surface 37 in a curtain wall system. A drainage plate 36 is placed on the solid base surface 37 in front of the curtain wall mullions 39 and is sealed to the surface 37 with sealing caulking 38. An inner transition member 40 is placed on top of the drainage plate 36 and fastened to the mullion 39 with fastener 41 and sealed to drainage plate 36 and surface 37 with sealing caulking 50. The inner transition member 40 has a horizontal web 42 with pressure equalization holes 43 and an upstanding structural interlocking male joint 44 which is designed to be compatible with a curtain wall system, such as my U.S. Pat. No. 4,840,004 or my copending U.S. patent application Ser. No. 08/033,332, filed Mar. 18, 1993, each of which are incorporated in their entirety by reference herein. In addition, the inner transition member 40 may include a thermal breaker 90 acting as an interconnecting member between the inner and outer portion of the inner transition member 40. The exterior member 45 is snapped onto the inner transition member 40 to conceal drainage plate 36 and inner transition member 40 and forms the exterior sill cavity 46 and the exterior air gap 47. The exterior member 45 has a vertical upward facing joint spline 48 designed to be compatible with the above-mentioned curtain wall system (not shown). If the curtain wall system above is not a pressure equalized system, the air flow from the air gap 47 through the holes 43 may not be adequate to pressure equalize the entire curtain wall system. Therefore, it is preferable to use the present invention in association with the above-mentioned pressure equalized curtain wall system.

If a pressure equalized curtain wall system is used, the interior sill cavity 49 formed between exterior sill member 45 and inner transition member 40 is assured to be a P.E. Cavity. The bottom surface of the interior sill cavity 49 serves as a bottom gutter of the curtain wall system. Since interior sill cavity 49 is a P.E. Cavity, water present in the interior sill cavity 49 will be drained through holes 43 onto drainage plate 36 and guided out through gap 47 as illustrated by the arrows. The sealing caulking 38 and 50 are D.P. Seals. From the above described and illustrated water path, it is apparent that water is prevented from reaching the D.P. Seals 38 and 50. Therefore, despite some possible imperfections in the D.P. Seals 38 and 50, there will be no water infiltration problem.

Figure 3:
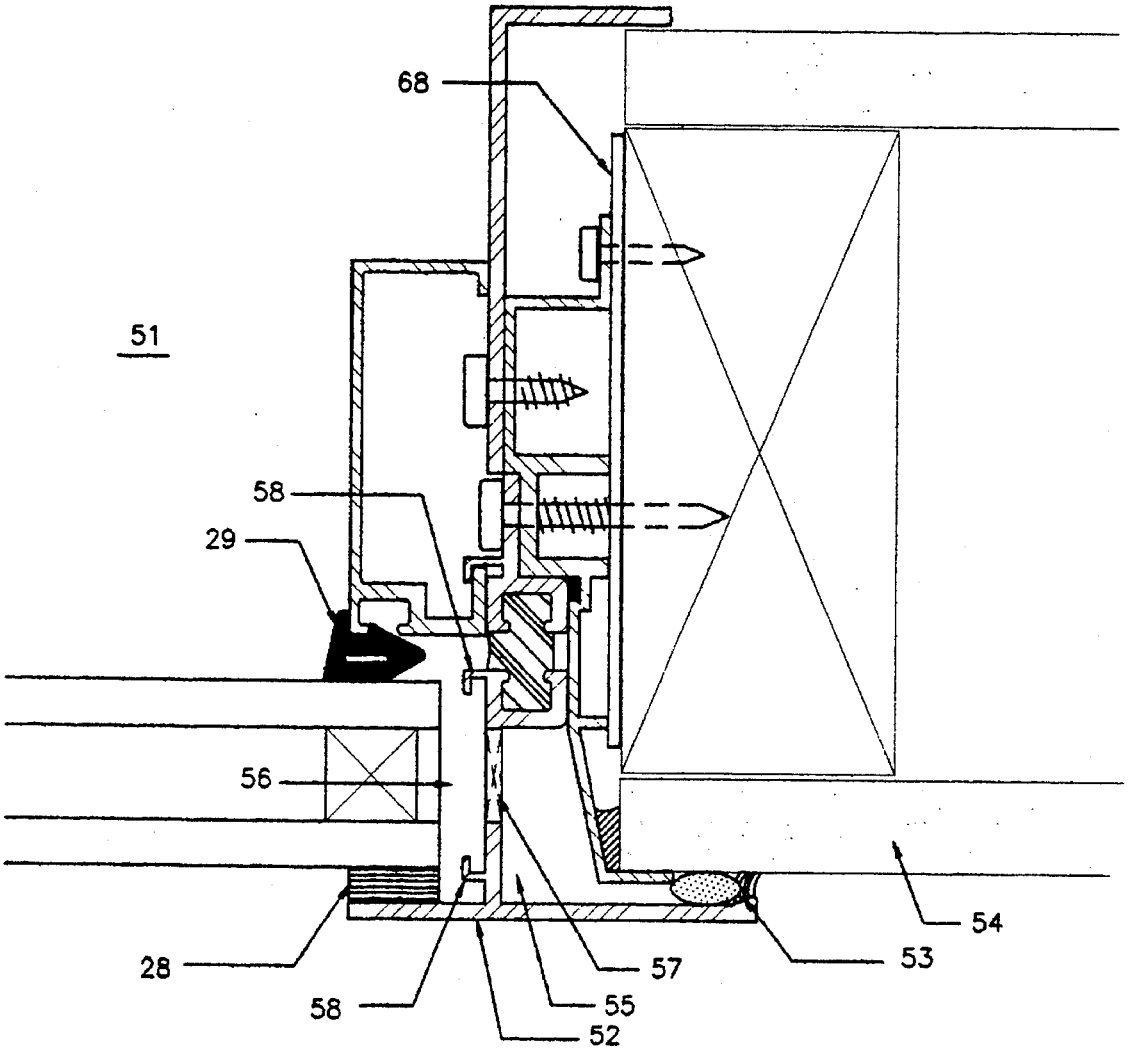
FIG. 3 is a typical fragmentary cross-sectional view taken along line 3—3 of FIG. 1 showing an example of the present invention at the jamb condition of a fixed window system which is compatible with the sill condition of FIG. 2.

FIG. 3 shows an example fragmentary cross-section of the vertical jamb perimeter 12 taken along line 3—3 of FIG. 1 which is compatible with the horizontal sill perimeter 11 of FIG. 2. It can be seen that all the components are identical with those shown in FIG. 2 except that the vertical jamb perimeter 12 is oriented in the vertical direction. Shims 68 may be used to absorb the tolerance between the window size and the opening size. The tip of exterior member 52 is sealed to the exterior wall surface 54 using sealing caulking 53. The exterior jamb cavity 55 is connected to the interior jamb cavity 56 by the pressure equalization holes 57. The interior jamb cavity 56 is connected to the interior sill cavity 26 which is a P.E. Cavity. Therefore, the pressure equalization air can freely flow from the sill cavities 24 and 26 (FIG. 2) into the jamb cavities 56 and 55, respectively, transforming the jamb cavities 56 and 55 into P.E. Cavities. Since the exterior jamb cavity 55 is a P.E. Cavity, the sealing caulking 53 becomes a P.E. Seal which can tolerate significant imperfections without causing the water infiltration problem. For the same reason, the exterior sponge gasket tape 28 is a P.E. Seal.

It is preferred that the exterior member 17 of the horizontal sill perimeter 11 is mitermatched at the corner with the exterior member 52 of the vertical jamb perimeter 12 so that the exterior jamb cavity 55 will also be connected to the exterior sill cavity 24 at the bottom. To facilitate the connection of the miter corner, clamping cleats 58 may be designed into members 17 and 52 to allow easy placement of corner connection keys.

Figure 3A:
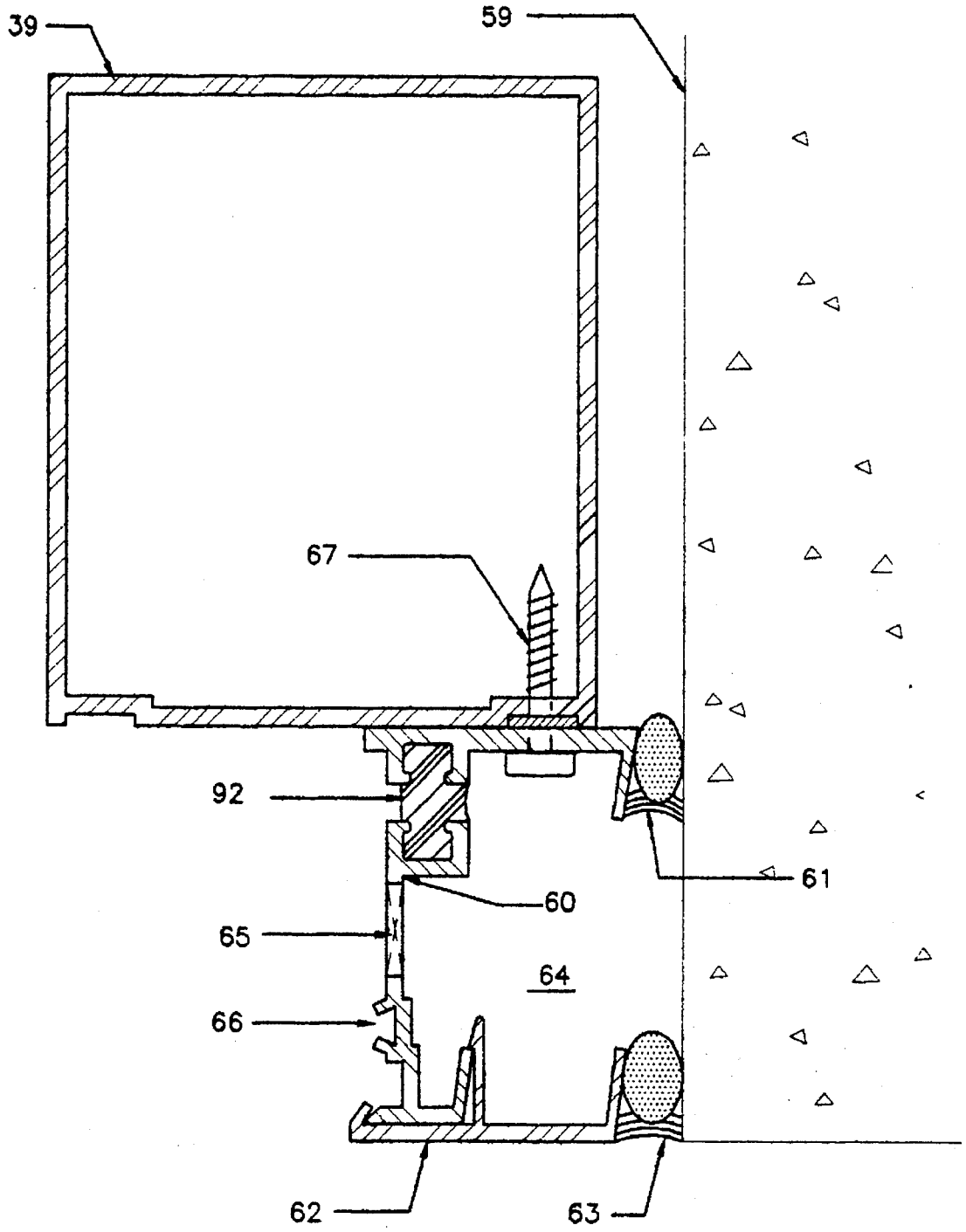
FIG. 3*a* is a variation of FIG. 3 showing an example of the present invention for the terminating jamb condition of a curtain wall system which is compatible with the sill condition of FIG. 2*a*.

FIG. 3*a* is a variation of the embodiment illustrated in FIG. 3 in which the vertical jamb 12 of a curtain wall system terminates at a solid wall opening surface 59. The inner transition member 60 of the vertical jamb 12, which may include a thermal breaker 92, is secured to the mullion 39 using spaced apart fasteners 67 and is sealed to the solid wall opening surface 59 with sealing caulking The exterior member 62 of the vertical jamb 12 is snapped onto inner transition member 60 and sealed to the surface 59 with sealing caulking 63. In the process, a terminating jamb cavity 64 is formed. The inner transition member 60 has pressure equalization holes 65 and a vertical joint spline adapting groove 66 which is designed to be compatible with the vertical joint design of the adjacent curtain wall system (not shown). It is essential for the present invention that the adjacent vertical joint cavity 64 be a P.E. Cavity of the type described in my previous U.S. Pat. No. 4,840,004 or my copending U.S. patent application Ser. No. 08/033,332, filed Mar. 18, 1993, so that the pressure equalization air can freely flow into the terminating jamb cavity 64 through the holes 65 to transform the terminating jamb cavity 64 into a P.E. Cavity. Since cavity 64 is a P.E. Cavity, the sealing caulking 63 becomes a P.E. Seal which can tolerate significant imperfection without resulting in damaging water infiltration. The sealing caulking 61 is a D.P. Seal. It is not, however, subjected to exterior running water. Therefore, imperfections in the sealing caulking line 61 will not produce the water infiltration problem.

Figure 4:
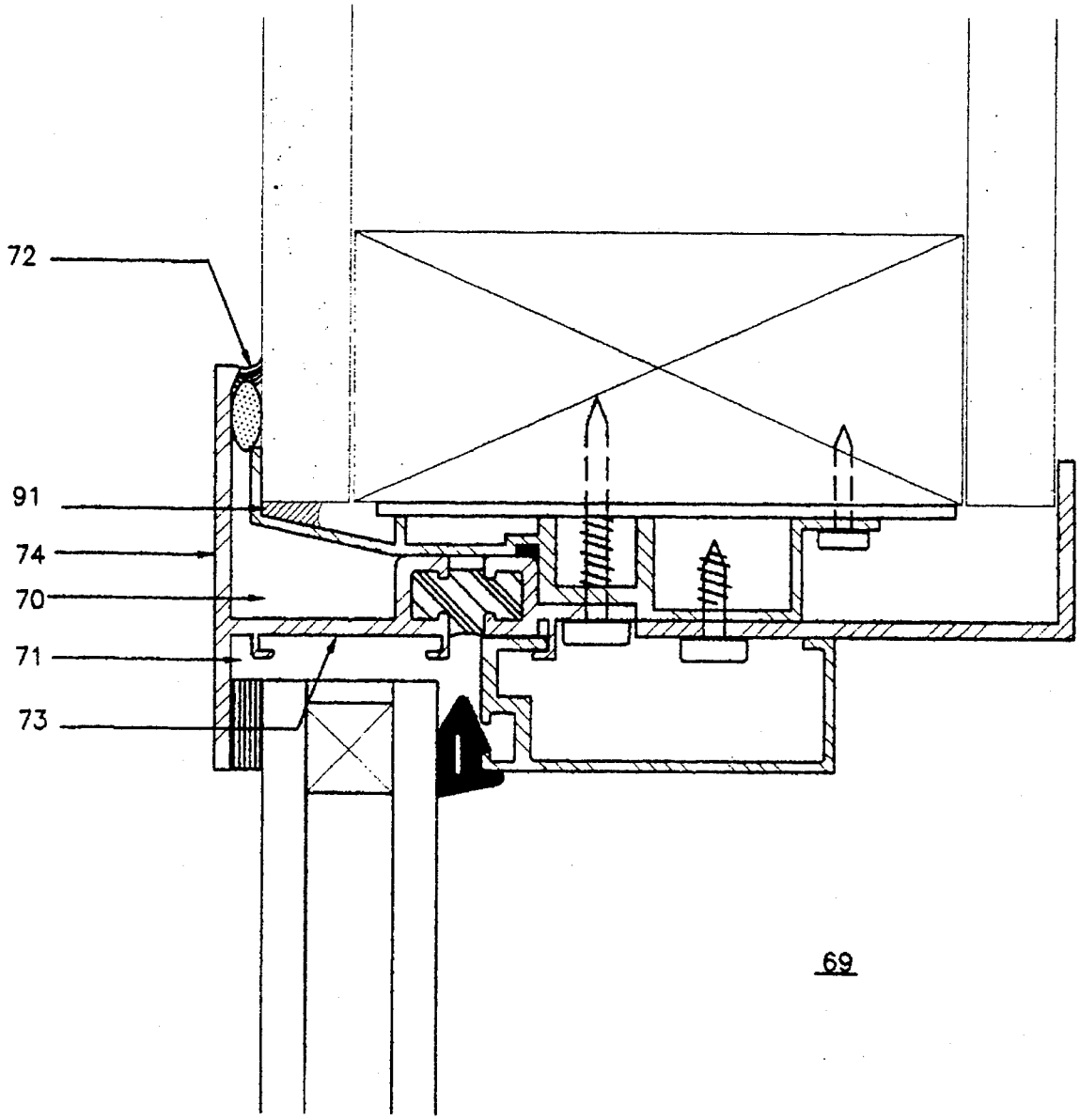
FIG. 4 is a fragmentary cross-sectional view taken along line 4—4 of FIG. 1 showing an example of the present invention at the head condition of a fixed window system which is compatible with the jamb condition of FIG.3.
Figure 4A:
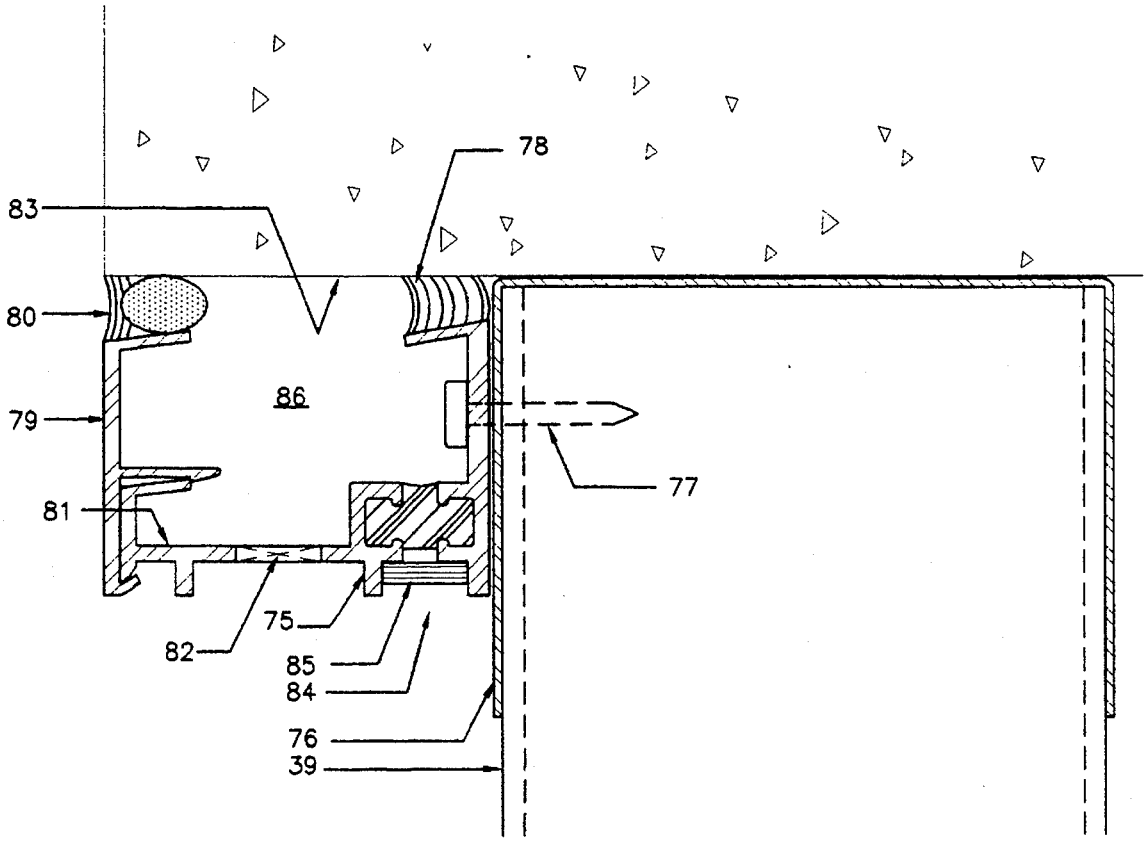
FIG. 4*a* is a variation of FIG. 4 showing an example of the present invention for the terminating head condition of a curtain wall system which is compatible with the jamb condition of FIG. 3*a*.

FIG. 4 shows an example fragmentary cross-section of the horizontal head perimeter 13 taken along line 4—4 of FIG. 1, which is compatible with the vertical jamb perimeter 12 of FIG. 3. It can be seen that all the components can be identical with those shown in FIG. 3 except, in this embodiment, that it is oriented in the horizontal direction. The exterior head cavity 70 is connected to the exterior jamb cavity 55, shown in FIG. 3 at the corner. The interior head cavity 71 is connected to the interior jamb cavity 56, shown in FIG. 3 at the corner. Since cavities 55 and 56 are P.E. Cavities, cavities 70 and 71 also become P.E. Cavities by virtue of the interconnections. Therefore, the sealing caulking 72 becomes a P.E. Seal which can tolerate significant imperfections without producing water infiltration problems. The horizontal web 73 of the exterior member 74 of the horizontal head member does not have any holes in order that it can serve as a gutter for draining incidental water getting through seals 72 and 91 to the exterior jamb cavity 55 and out from the air gap 23 of the horizontal sill perimeter FIG. 4*a* is a variation of FIG. 4 in which the head of a curtain wall system terminates at a solid wall opening surface 83. The inner transition member 75 of this embodiment, which may include a thermal breaker material 96, is fastened through the mullion cap 76 into the mullion 39 using fastener 77 and sealed to the mullion cap 76 and the solid wall opening surface 83 using sealing caulking 78. The exterior member 79 of this embodiment is then snapped onto the inner transition member 75 and sealed to surface 83 using sealing caulking 80. In the process, a terminating head cavity 86 is formed. The horizontal web 81 of member 75 has spaced apart pressure equalization holes 82 and a downward-facing female joint 84 which is compatible with the curtain wall system below (as previously described in U.S. Pat. No. 4,840,004, not shown) and sealed with joint sealing tape 85. It is essential for the present invention that the horizontal wall cavity 89 beneath the holes 82 be a P.E. Cavity so that pressure equalization air can freely flow through the holes 82 into the cavity 86 to transform the cavity 86 into a P.E. Cavity. Since the cavity 86 is a P.E. Cavity, the sealing caulking 80 becomes a P.E. Seal which can tolerate significant imperfections without producing water infiltration problems. Although the sealing caulking 78 is a D.P. Seal, exterior water cannot reach the location of sealing caulking 78 by virtue of the P.E. Cavity, inner transition member 75, web 81 and holes 82.

The present invention may be adapted for use in all window systems requiring at least one perimeter, i.e, triangular, trapezoidal, rectangular, hexagonal, round, oval, etc. In addition, each perimeter may also be nonlinear in shape, i.e., curved or having curved portions.

In summary, the present invention acknowledges the fact that imperfections in a sealant line such as pinholes and hairline cracks are not preventable. In sealing the perimeter conditions, the present invention categorizes all sealing lines into two types, namely, D.P. Seals and P.E. Seals. Living with the imperfect sealant line assumption, the water infiltration through a D.P. Seal is reduced by locating the D.P. Seal away from the possible path of the exterior running water. Where a sealant line is in the path of the exterior running water, a P.E. Cavity is created behind the sealant line by linking to the exterior air so that the sealant line will become a P.E. Seal. Since the differential air pressure disappears at a P.E. Seal, the P.E. Seal can tolerate significant imperfections without producing water infiltration. In consideration of possible incidental water infiltration through a P.E. Seal, the present invention further incorporates a hidden drainage system within the P.E. Cavities created by the design.

While I have illustrated and described several embodiments of my invention, it will be understood that these are by way of illustration only and that various changes and modifications may be contemplated in my invention and within the scope of the following claims.

I claim:

1. A perimeter sealing structure for sealing a wall enclosing structure into an opening in an exterior wall structure for preventing water infiltration through said opening comprising:

at least one perimeter having:

(a) an inner transition member overlaying said opening in said exterior wall structure and being secured to a surface adjacent to an exterior surface of said wall structure and sealed to said wall structure using a sealant;

(b) an exterior member being secured to said inner transition member wherein at least one pressure equalized wall cavity is formed between said exterior member and said inner transition member, and an air gap is formed between said wall opening surface and said exterior member; and (c) means for allowing exterior air to enter said wall cavity.

2. A perimeter sealing structure according to claim 1, wherein said inner transition member is an extrusion.

3. A perimeter sealing structure according to claim 2, wherein said extrusion is an aluminum extrusion.

4. A perimeter sealing structure according to claim 2, wherein said extrusion is an extruded PVC member.

5. A perimeter sealing structure according to claim 1, wherein said exterior member is an extrusion.

6. A perimeter sealing structure according to claim 5, wherein said extrusion is an aluminum extrusion.

7. A perimeter sealing structure according to claim 5, wherein said extrusion is an extruded PVC member.

8. A perimeter sealing structure according to claim 1, wherein the means for allowing air to enter each of said wall cavities is said air gap.

9. A perimeter sealing structure according to claim 1, wherein said means for allowing air to enter each of said wall cavity of said at least one perimeter are provided by pressure equalization holes in said exterior member leading to an air passageway terminating at the entrance of the exterior air.

10. A perimeter sealing structure according to claim 1, including a plurality of perimeters each having at least one wall cavity, wherein said means for allowing air to enter each of said wall cavity is provided by linking said wall cavity in each said perimeter to form a continuous cavity.

11. A perimeter sealing structure according to claim 1, wherein said structure comprises four perimeters.

12. A perimeter sealing structure for sealing a wall enclosing structure into an opening in an exterior wall structure for preventing water infiltration through said opening comprising at least one perimeter having:

(a) an inner transition member fastened to a surface adjacent to an exterior surface of said exterior wall structure;

(b) an exterior member fastened to said inner transition member wherein at least one wall cavity is formed between said inner transition member and said exterior member; an air gap formed between said opening and said exterior member;

(c) means for allowing exterior air to enter said wall cavity.

13. A perimeter sealing structure according to claim 12 wherein said exterior member comprises an inner portion and outer portion.

14. A perimeter sealing structure according to claim 13 wherein said exterior member comprises a thermal breaker to connect said inner portion and said outer portion of said exterior member.

15. A perimeter sealing structure according to claim 12 wherein said inner transition member comprises a front portion, said front portion having a downwardly sloping surface.

16. A perimeter sealing structure according to claim 15 wherein said exterior member comprises a downwardly extended leg to conceal said inner transition member.

17. A perimeter sealing structure according to claim 12, wherein said means for allowing air to enter each of said wall cavity of said at least one perimeter are provided by pressure equalization holes in said exterior member leading to an air passageway terminating at the entrance of the exterior air.

18. A perimeter sealing structure according to claim 12, wherein said wall enclosing structure is interposed between an exterior gasket and interior gasket and is supported by at least one spaced apart setting blocks.

19. A perimeter sealing structure according to claim 12, wherein said at least one wall cavity is a pressure equalized cavity.

* * * * *